US012543848B2

(12) United States Patent
Leng

(10) Patent No.: US 12,543,848 B2
(45) Date of Patent: Feb. 10, 2026

(54) LOCKING MECHANISM FOR SLIDING ROD HAVING TWO SPHERICAL HEADS AND FOLDABLE TABLE

(71) Applicant: New-Tec Integration (Xiamen) Co., Ltd., Fujian (CN)

(72) Inventor: Luhao Leng, Fujian (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 144 days.

(21) Appl. No.: 18/426,928

(22) Filed: Jan. 30, 2024

(65) Prior Publication Data

US 2024/0251937 A1 Aug. 1, 2024

(30) Foreign Application Priority Data

Jan. 31, 2023 (CN) ..... 202320159408.8

(51) Int. Cl.
*A47B 3/00* (2006.01)
*A47B 3/08* (2006.01)
*A47B 3/091* (2006.01)

(52) U.S. Cl.
CPC ..... *A47B 3/0809* (2013.01); *A47B 3/0916* (2013.01)

(58) Field of Classification Search
CPC ..... A47B 3/0809; A47B 3/0916; A47B 3/087; A47B 3/0913; A47B 3/0915; A47B 3/0815; A47B 3/0818; A47B 3/091; A47B 3/0912
USPC ..... 108/126, 128–133, 160, 36; 248/188.6, 248/239
See application file for complete search history.

(56) References Cited

U.S. PATENT DOCUMENTS 3,769,920 A * 11/1973 Weiss ..... A47B 3/0918 108/133
6,058,853 A * 5/2000 Pinch ..... A47B 3/087 108/36
6,817,684 B2 * 11/2004 Cattaneo ..... A47B 21/06 108/50.02

(Continued)

FOREIGN PATENT DOCUMENTS

CN 202858218 U * 4/2013
CN 111493515 A * 8/2020 ..... A47B 3/0916

(Continued)

OTHER PUBLICATIONS

FR3077713 English translation (Year: 2018).*
CN202858218 English translation (Year: 2013).*

*Primary Examiner* — Janet M Wilkens
(74) *Attorney, Agent, or Firm* — Cooper Legal Group, LLC

(57) ABSTRACT

A locking mechanism for a sliding rod having two spherical heads comprises the sliding rod, a sliding seat, and a locking device. The sliding seat is slidably mounted on the sliding rod along a length direction of the sliding rod. The locking device comprises the two spherical heads, one or more elastic members, and a button. The sliding seat comprises two buckle holes configured to correspond to the two spherical heads. The button is mounted at a position of the sliding seat corresponding to the two buckle holes. The two spherical heads are configured to be locked to the two buckle holes to inhibit sliding movement of the sliding seat, and the button is configured to act on the two spherical heads to drive the two spherical heads to exit from the two buckle holes to release the sliding seat from being inhibited from movement.

13 Claims, 7 Drawing Sheets

(56) References Cited

U.S. PATENT DOCUMENTS

| | | | | |
|---|---|---|---|---|
| 10,806,247 | B1 * | 10/2020 | Chen | A47B 3/0913 |
| 12,262,809 | B2 * | 4/2025 | Choi | A47B 3/0913 |
| 2010/0175594 | A1 * | 7/2010 | Leng | A47C 11/00 108/115 |
| 2013/0000528 | A1 * | 1/2013 | Jin | A47B 3/0915 108/127 |
| 2021/0045537 | A1 * | 2/2021 | Leng | A47C 19/126 |
| 2025/0009120 | A1 * | 1/2025 | Leng | A47B 13/02 |

FOREIGN PATENT DOCUMENTS

| | | | | |
|---|---|---|---|---|
| CN | 112450596 | A * | 3/2021 | A47B 13/003 |
| CN | 217851797 | U * | 11/2022 | A47B 3/0915 |
| FR | 3077713 | A1 * | 8/2019 | A47B 3/0916 |
| TW | M276486 | * | 10/2005 | |

* cited by examiner

LOCKING MECHANISM FOR SLIDING ROD HAVING TWO SPHERICAL HEADS AND FOLDABLE TABLE

RELATED APPLICATIONS

This application claims priority to Chinese patent application number 202320159408.8, filed on Jan. 31, 2023. Chinese patent application number 202320159408.8 is incorporated herein by reference.

FIELD OF THE DISCLOSURE

The present disclosure relates to the field of furniture, and in particular to a locking mechanism for a sliding rod having two pins and a foldable table.

BACKGROUND OF THE DISCLOSURE

Tables are essential equipment in daily life and are widely used in various homes and offices. In order to avoid taking up excessive space when the tables are not in use, a variety of foldable tables have appeared on the market. These foldable tables mainly operate through folding or shrinking of a support frame to achieve a purpose of occupying a small floor space.

However, a folding mechanism used in the foldable tables in the existing technology have complex structures, and most of them require multiple parts to be used together, resulting in reduced performance and being prone to failure.

Additionally, most of the folding mechanisms do not have a locking mechanism. When the foldable table is supported by a support frame, the support frame can easily fold due to external forces, resulting in an unstable desktop and poor pressure resistance.

BRIEF SUMMARY OF THE DISCLOSURE

The present disclosure provides a locking mechanism for a sliding rod having two pins and a foldable table to solve the deficiencies in the background, achieving supporting legs of the foldable table having a locking mechanism and improving the foldable table's support, stability, and pressure resistance.

A locking mechanism for a sliding rod having two pins comprises the sliding rod, a sliding seat, and a locking device. The sliding seat is slidably mounted on the sliding rod to have an amount of sliding along a length direction of the sliding rod, and the locking device comprises the two pins, one or more elastic members, and a button. The two pins are equipped with the one or more elastic members to be mounted on the sliding rod, and the sliding seat comprises two buckle holes configured to correspond to the two pins. The button is mounted at a position of the sliding seat corresponding to the two buckle holes, and the two pins are configured to be locked to the two buckle holes to inhibit sliding movement of the sliding seat. The button is configured to act on the two pins to drive the two pins to exit from the two buckle holes to release the sliding seat from being inhibited from movement.

Preferably, two sides of the sliding rod are recessed to form two sliding grooves, and two side lugs of the sliding seat are disposed in the two sliding grooves to form a sliding cooperation.

Preferably, the sliding seat comprises an outer lid, a seat, and an inner sleeve. The seat comprises the two buckle holes corresponding to the two pins, and the outer lid is deposed with the button corresponding to the two buckle holes.

Preferably, a side of the seat facing the two pins splays outward to form an inclined surface with a slope gradient, and the inclined surface is configured to act on the two pins to drive the two pins to move back into the sliding rod by a sliding amount to enable the one or more elastic members to form an elastic force.

Preferably, an inside of the button comprises an abutting rod configured to correspond to the two pins.

Preferably, the two pins are spaced apart from each other.

A foldable table comprises the locking mechanism, a tabletop, and four supporting legs pivotally connected to four corners of the tabletop. The sliding rod is fixedly connected to a middle of a bottom surface of the tabletop, and the sliding rod is disposed with two of the sliding seats opposite to each other. Each of the two of the sliding seats is equipped with one or more oblique rods which are operatively coupled to a corresponding two of the four supporting legs.

Preferably, the sliding rod is disposed with two sets of the two pins configured to correspond to the two of the sliding seat, and the four supporting legs are perpendicular to the tabletop when the two of the sliding seats is locked to a corresponding one of the two sets of the two pins.

Compared with the existing techniques, the technical solution has the following advantages.

1. The present disclosure provides the locking mechanism for the sliding rod having the two pins adapted to the foldable table, and a sliding cooperation between the sliding rod and the sliding seat drives the four supporting legs to achieve folding and unfolding. The two pins are used to lock the sliding seat. When the four supporting legs are in an unfolded position, the two pins further stabilize the foldable table in use and improve the foldable table's support, stability, and pressure resistance.

2. The sliding grooves of the sliding rod enables the two side lugs of the sliding seat to be lower than the sliding rod when mounting. When the sliding rod is mounted to the lower side of the tabletop, the sliding rod does not need to keep a position-providing space between the lower side of the tabletop to mount the two side lugs of the sliding seat, so as to ensure a flatness of the lower side of the tabletop.

Description of reference signs: 1—Sliding rod; 11—Sliding groove; 12—Two pins; 13—Elastic member; 2—Sliding seat; 21—Buckle hole; 22—Button; 23—Outer lid; 24—Seat; 25—Inner sleeve; 26—Inclined surface;

27—Abutting rod; 28—Rivets; 3—Foldable table; 31—Tabletop; 32—Supporting leg; 33—Oblique rod.

DETAILED DESCRIPTION OF THE EMBODIMENTS

The present disclosure will be further described below in combination with FIGS. 1 to 8.

Figure 2:
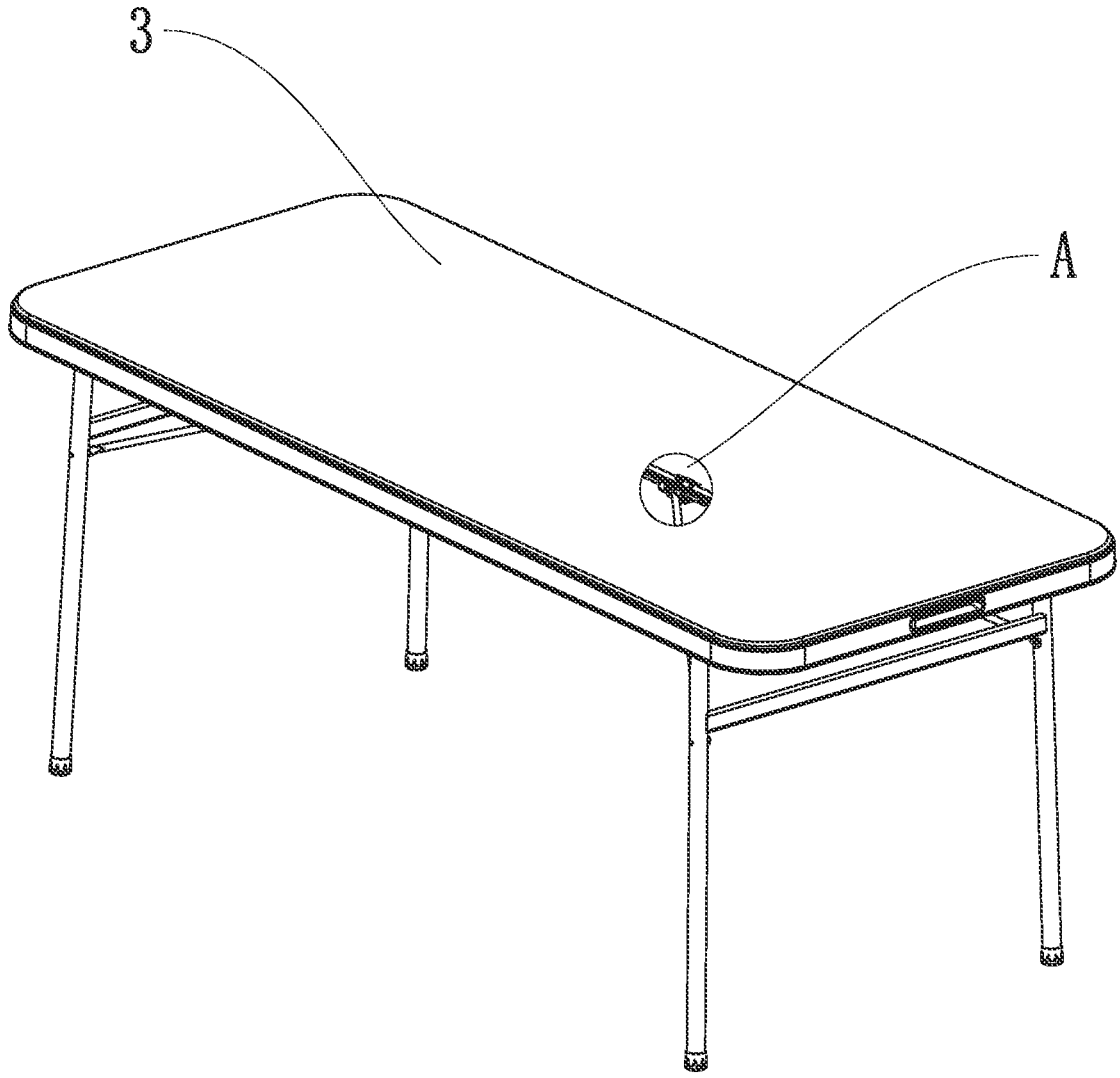
FIG. 2 illustrates a perspective view of the foldable table when in a use state in the present embodiment.
Figure 3:
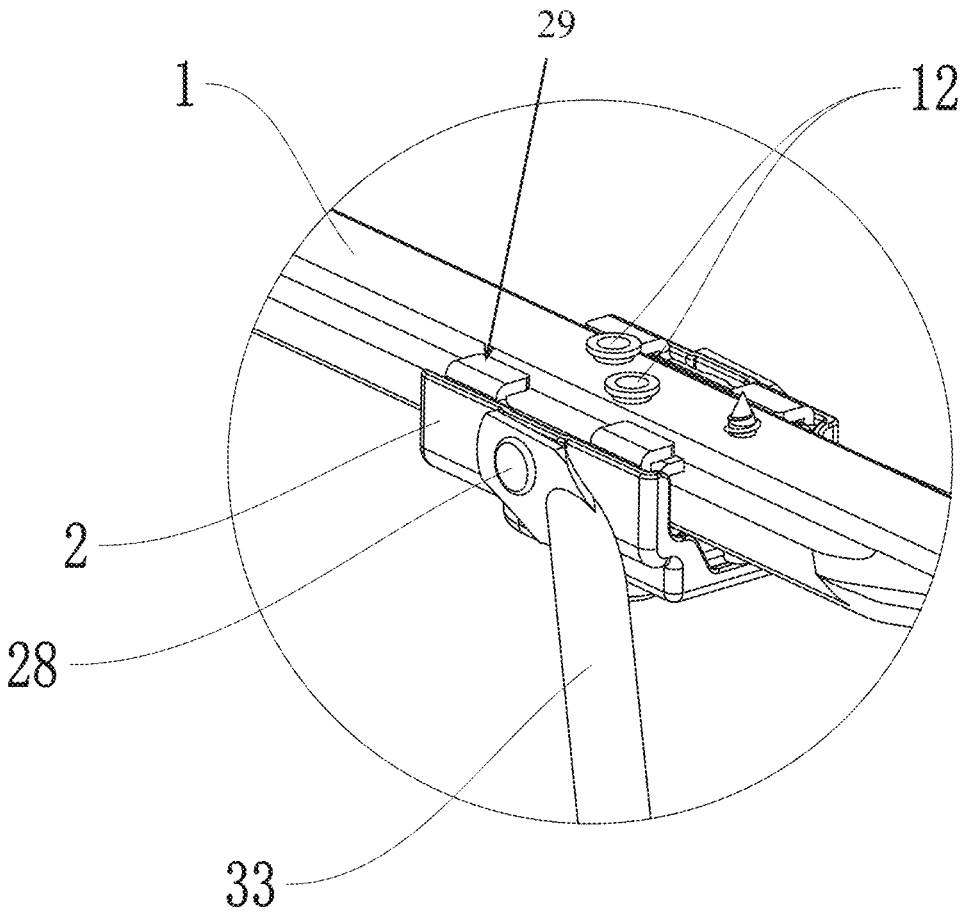
FIG. 3 illustrates an enlarged view of A portion in FIG. 2.
Figure 4:
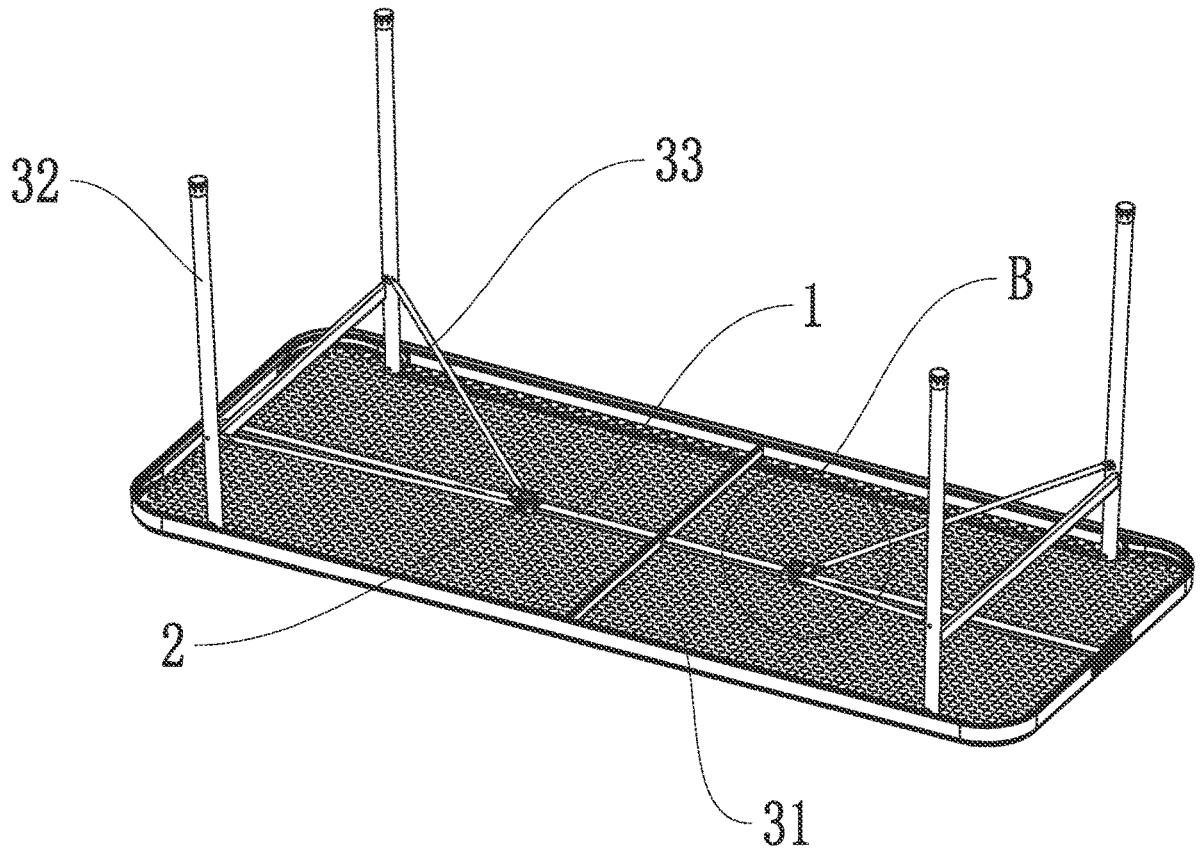
FIG. 4 illustrates a perspective view of the locking mechanism on the foldable table in the present embodiment.

The present disclosure provides a locking mechanism for a sliding rod 1 having two pins 12, and the locking mechanism is mainly adapted for use with a foldable table 3. Referring to FIG. 2, the foldable table 3 comprises a tabletop 31 and four supporting legs 32 pivotally connected to four corners of the tabletop 31. The locking mechanism for the sliding rod 1 having the two pins 12 provided by the present disclosure is mounted on a middle of a bottom surface of the tabletop 31. Referring to FIG. 4, the locking mechanism comprises the sliding rod 1, a sliding seat 2, and a locking device. The sliding seat 2 is slidably mounted on the sliding rod 1 to have an amount of sliding along a length direction of the sliding rod 1. Two sides of the sliding seat 2 are respectively pivotally equipped with two oblique rods 33 to be connected to a corresponding two of the four supporting legs 32. The two oblique rods 33 are pivotally connected to the corresponding two of the four supporting legs 32, and the corresponding two of the four supporting legs 32 are foldable relative to the tabletop 31 through the sliding seat 2 driving the corresponding two of the four supporting legs 32 to rotate through the two oblique rods 33.

Preferably, a number of the sliding rods 1 is one, and the sliding rod 1 extends along a long side direction of the tabletop 31 to enable two ends of the sliding rod 1 to extend to two short sides of the tabletop 31. Two of the sliding seats 2 are slidably disposed on the sliding rod 1, which are opposite to each other. Two sides of each of the two sliding seats 2 are respectively pivotally equipped with a corresponding set of the two oblique rods 33 through rivets 28 to be operatively coupled to a corresponding set of two of the four supporting legs 32, so as to enable the four supporting legs 32 to rotate to achieve folding.

Figure 5:
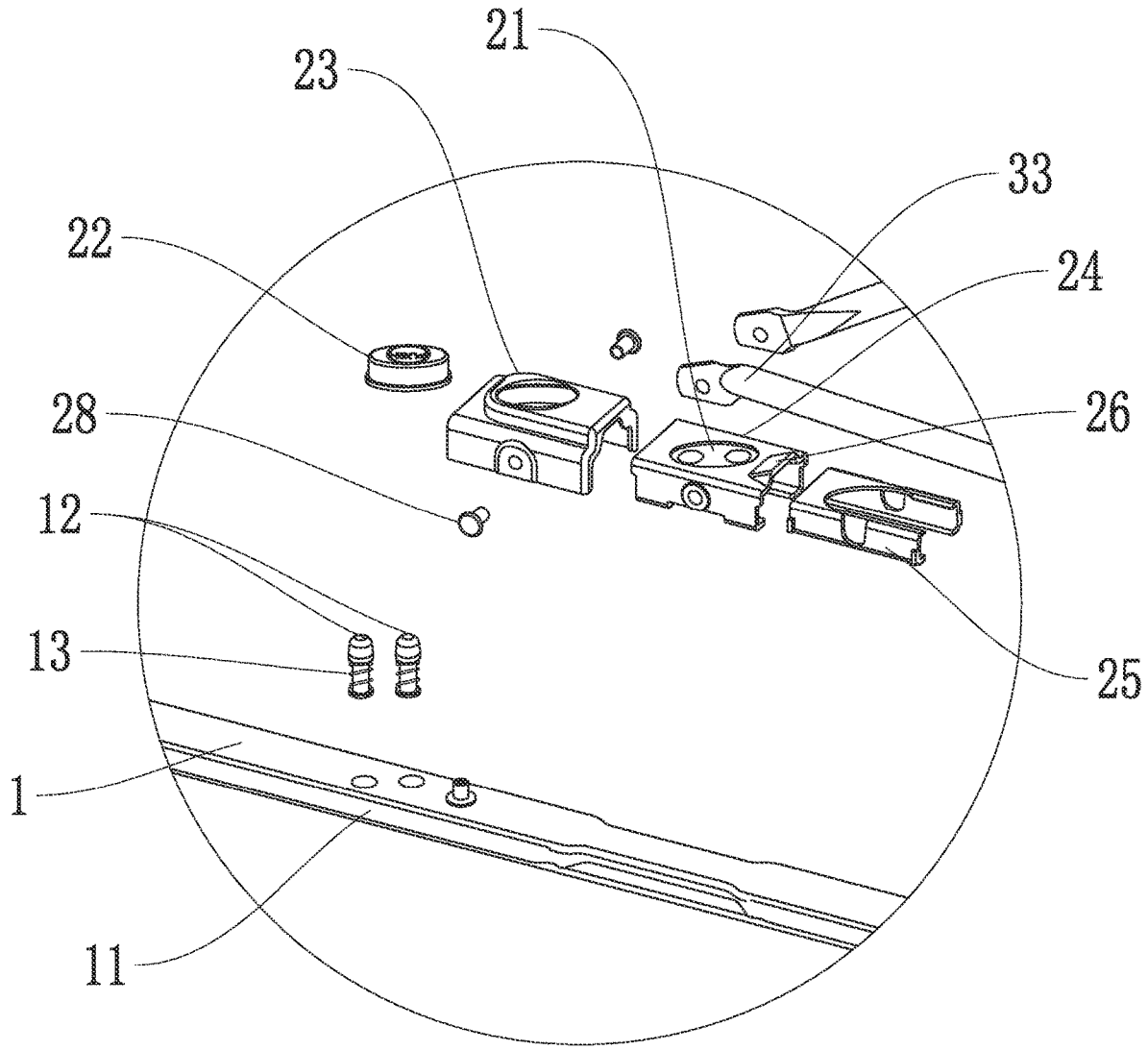
FIG. 5 illustrates an enlarged and exploded view of B portion in FIG. 2.
Figure 6:
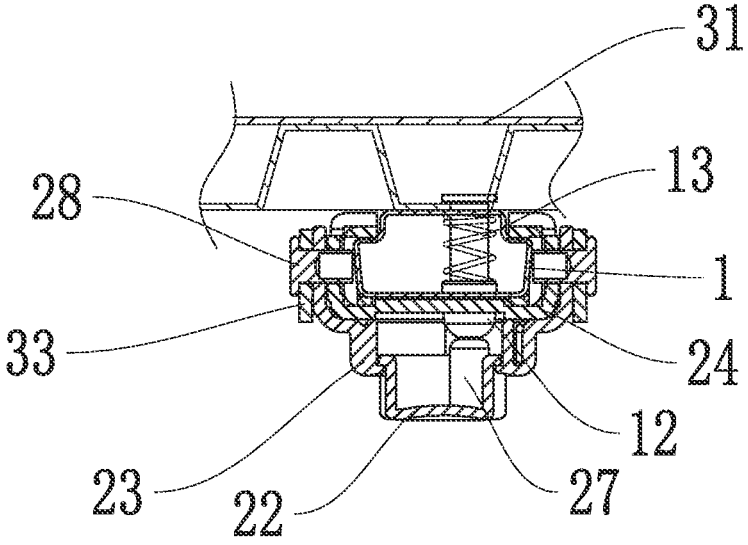
FIG. 6 illustrates a cross-sectional view of the locking mechanism in the present embodiment.

Referring to FIG. 5, the locking device of the present disclosure comprises the two pins 12, two elastic members 13, and a button 22. Each of the two pins 12 is a supporting rod having a head portion, and the two elastic members 13 are springs. The two pins 12 are elastically mounted on the sliding rod 1 through the springs, and the head portion can be pressed to move into the sliding rod 1 by an external force compressing the springs.

The sliding seat 2 comprises an outer lid 23, a seat 24, and an inner sleeve 25. The seat 24 comprises two buckle holes 21 corresponding to the two pins 12, and the outer lid 23 is deposed with the button 22 corresponding to the two buckle holes 21. A bottom of the seat 24 comprises the two buckle holes 21. The two pins 12 extend in a vertical direction.

Figure 8:
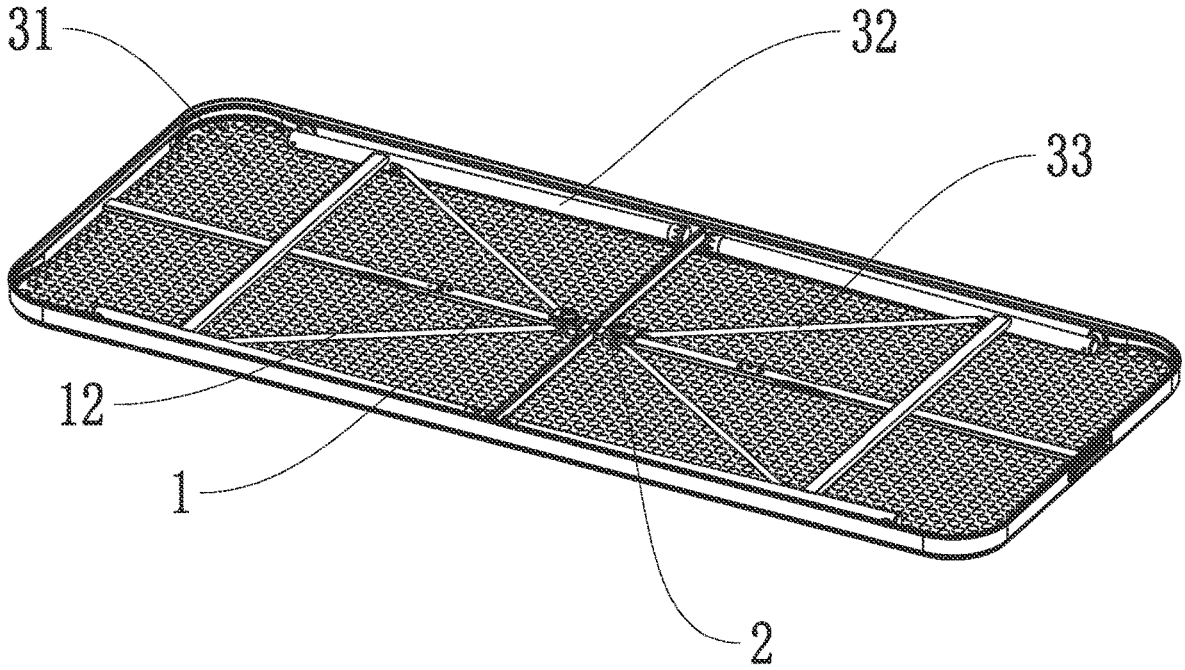
FIG. 8 illustrates a perspective view of the locking mechanism on the foldable table when in a storage state in the present embodiment.

Referring to FIG. 8, during use, when the four supporting legs 32 are unfolded, the four supporting legs 32 drive the two of the sliding seats 2 to slide on the sliding rod 1 through the two oblique rods 33. When the four supporting legs 32 are unfolded to a certain angle, the head portions of the two pins 12 are inserted into the two buckle holes 21 to lock the two of the sliding seats 2 to enable the four supporting legs 32 to be locked at a certain angle position. When the four supporting legs 32 are folded, the button 22 is pressed to enable the two pins 12 to move out of the two buckle holes 21 so as to release a locking of the two of the sliding seats 2, and the four supporting legs 32 move to drive the sliding seat 2 to slide back to an original position to achieve folding.

It should be noted that a position of the two pins 12 on the sliding rod 1 is a fixed position to ensure that the four supporting legs 32 are perpendicular to the tabletop 31 when the sliding seat 2 is locked to the two pins 12.

Figure 1:
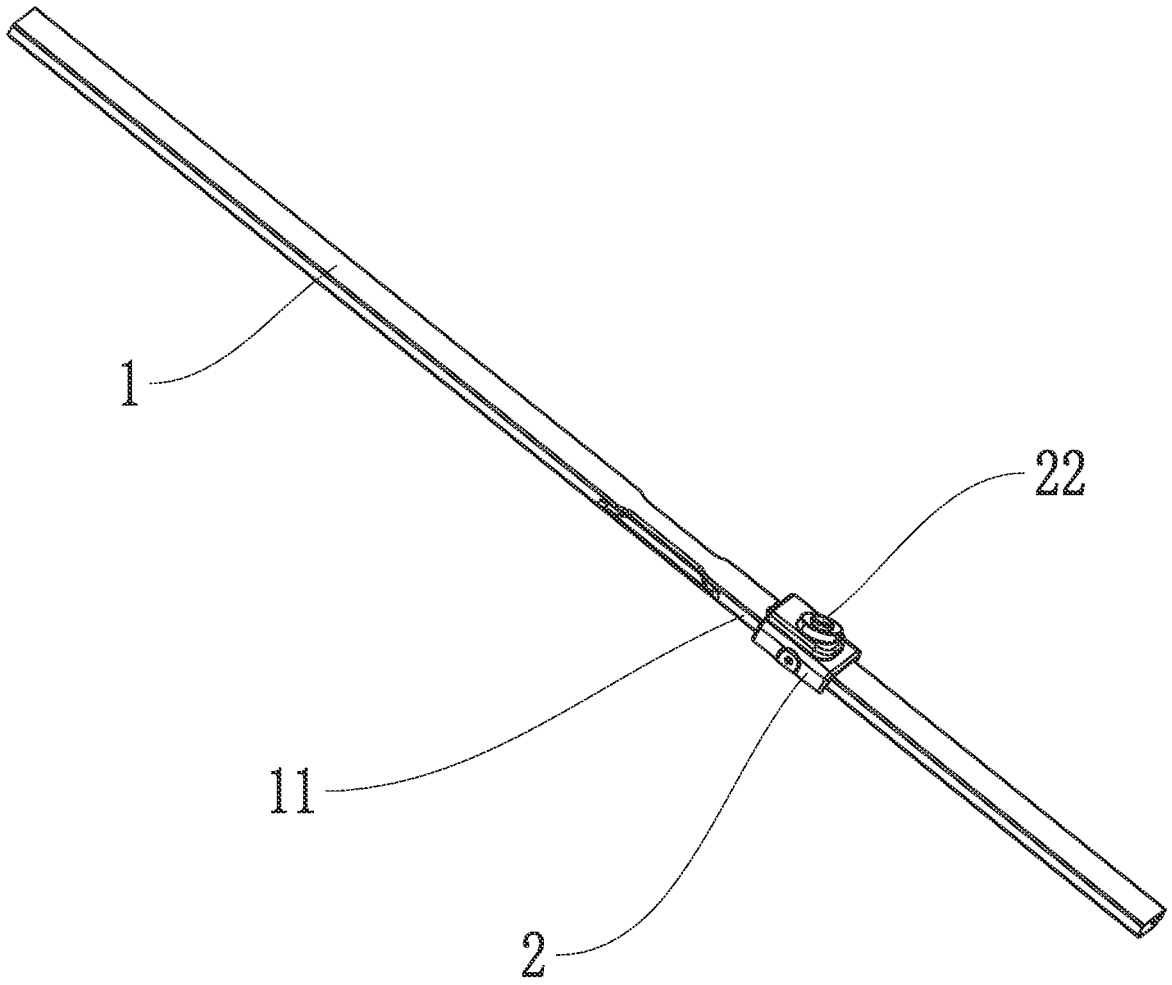
FIG. 1 illustrates an overall perspective view of a locking mechanism of a foldable table in the present embodiment.

Preferably, two sides of the sliding rod 1 are recessed to form two sliding grooves 11, and referring to FIG. 1, two side lugs 29 of the sliding seat 2 are inserted into the two sliding grooves 11 to form a sliding cooperation. The sliding grooves 11 of the sliding rod 1 enable the two side lugs 29 of the sliding seat 2 to be lower than the sliding rod 1 when mounting, and when the sliding rod 1 is mounted to the lower side of the tabletop 31, the sliding rod 1 does not need to keep a position-providing space between the lower side of the tabletop 31 to mount the two side lugs 29 of the sliding seat 2, so as to ensure a flatness of the lower side of the tabletop 31.

In this locking mechanism for the sliding rod 1, the two pins 12 are spaced apart from each other to ensure a firm connection to the seat 24 of the sliding seat 2. A side of the seat 24 facing the two pins 12 splays outward to form an inclined surface 26 with a certain slope gradient. The inclined surface 26 can act on the two pins 12 during the sliding seat 2 sliding to drive the two pins 12 to move back into the sliding rod 1 by a certain sliding amount to enable the two elastic members 13 to form an elastic force. When the two buckle holes of the seat 24 move to correspond to the two pins 12, the two elastic members 13 drive the two pins 12 to be locked to the two buckle holes 21 to achieve locking.

Figure 7:
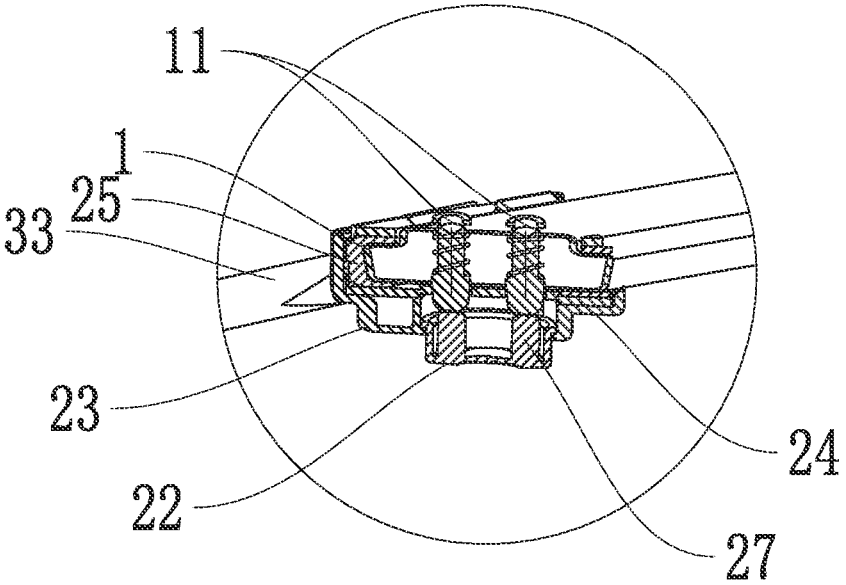
FIG. 7 illustrates a cross-sectional view of a button cooperating with two pins in the present embodiment.

Referring to FIG. 7, preferably, the button 22 is oval. An inside of the button 22 comprises an abutting rod 27 configured to correspond to the two pins 12 to ensure that the two pins 12 can completely exit from the two buckle holes 21 to release the sliding seat 2 from being inhibited from movement when pressing the button 22, and the locking mechanism can work well.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A locking mechanism of a sliding rod having two pins, comprising:

the sliding rod, a sliding seat, and a locking device, wherein:

the sliding seat is slidably mounted on the sliding rod to have an amount of sliding along a length direction of the sliding rod, the locking device comprises the two pins, one or more elastic members, and a button, the two pins are equipped with the one or more elastic members to be mounted on the sliding rod, the sliding seat comprises two buckle holes configured to correspond to the two pins, the button is mounted at a position of the sliding seat corresponding to the two buckle holes, the two pins are configured to be locked to the two buckle holes to inhibit sliding movement of the sliding seat, the button is configured to act on the two pins to drive the two pins to exit the two buckle holes to release the sliding seat from being inhibited from movement, and an inside of the button comprises one or more abutting rods configured to enable the two pins to be separated from the two buckle holes.

2. The locking mechanism of the sliding rod having the two pins according to claim 1, wherein:

two sides of the sliding rod are recessed to form two sliding grooves, and two side lugs of the sliding seat are disposed in the two sliding grooves to form a sliding cooperation.

3. The locking mechanism of the sliding rod having the two pins according to claim 1, wherein:

the sliding seat comprises an outer lid, a seat, and an inner sleeve, the seat comprises the two buckle holes corresponding to the two pins, and the outer lid is deposed with the button corresponding to the two buckle holes.

4. The locking mechanism of the sliding rod having the two pins according to claim 3, wherein:

a side of the seat facing the two pins splays outward to form an inclined surface with a slope gradient, and the inclined surface is configured to act on the two pins to drive the two pins to move back into the sliding rod by a sliding amount to enable the one or more elastic members to form an elastic force.

5. The locking mechanism of the sliding rod having the two pins according to claim 3, wherein a bottom of the seat comprises the two buckle holes.

6. The locking mechanism of the sliding rod having the two pins according to claim 1, wherein:

the two pins are spaced apart from each other.

7. A foldable table, comprising:

the locking mechanism according to claim 1, a tabletop, and four supporting legs pivotally connected to four corners of the tabletop, wherein:

the sliding rod is fixedly connected to a middle of a bottom surface of the tabletop, the sliding rod is disposed with two of the sliding seats opposite to each other, and each of the two of the sliding seats is equipped with one or more oblique rods which are operatively coupled to a corresponding two of the four supporting legs.

8. The foldable table according to claim 7, wherein:

the sliding rod is disposed with two sets of the two pins configured to correspond to the two of the sliding seats, and the four supporting legs are perpendicular to the tabletop when the two of the sliding seats are locked to a corresponding one of the two sets of the two pins.

9. The foldable table according to claim 7, wherein:

two sides of the sliding rod are recessed to form two sliding grooves, and two side lugs of each of the two of the sliding seats are disposed in the two sliding grooves to form a sliding cooperation.

10. The foldable table according to claim 7, wherein:

each of the two of the sliding seats comprises an outer lid, a seat, and an inner sleeve, the seat comprises the two buckle holes corresponding to the two pins, and the outer lid is deposed with the button corresponding to the two buckle holes.

11. The foldable table according to claim 10, wherein:

a side of the seat facing the two pins splays outward to form an inclined surface with a slope gradient, and the inclined surface is configured to act on the two pins to drive the two pins to move back into the sliding rod by a sliding amount to enable the one or more elastic members to form an elastic force.

12. The foldable table according to claim 7, wherein:

the two pins are spaced apart from each other.

13. The locking mechanism of the sliding rod having the two pins according to claim 1, wherein the two pins extend in a vertical direction.

* * * * *